US010602789B2

(12) United States Patent
Schattner

(10) Patent No.: US 10,602,789 B2
(45) Date of Patent: Mar. 31, 2020

(54) TECHNIQUES FOR MATCHING AND COMBINING DISTINCT FABRICS INTO A SINGLE ARTICLE OF CLOTHING

(71) Applicant: Lawrence Hunt Fashion, Inc., Royal Oak, MI (US)

(72) Inventor: Jeffrey Michael Schattner, Royal Oak, MI (US)

(73) Assignee: Lawrence Hunt Fashion, Inc., Royal Oak, MI (US)

( * ) Notice: Subject to any disclaimer, the term of this patent is extended or adjusted under 35 U.S.C. 154(b) by 193 days.

(21) Appl. No.: 15/818,951

(22) Filed: Nov. 21, 2017

(65) Prior Publication Data

US 2018/0140023 A1 May 24, 2018

Related U.S. Application Data

(60) Provisional application No. 62/425,134, filed on Nov. 22, 2016.

(51) Int. Cl.

| | |
|---|---|
| ***A41D 27/00*** | (2006.01) |
| ***A41B 1/00*** | (2006.01) |
| ***A41H 42/00*** | (2006.01) |
| ***A41B 1/08*** | (2006.01) |
| ***A41H 3/08*** | (2006.01) |

(52) U.S. Cl.

CPC ..... *A41D 27/00* (2013.01); *A41B 1/00* (2013.01); *A41B 1/08* (2013.01); *A41H 3/08* (2013.01);

(Continued)

(58) Field of Classification Search

CPC ..... A41D 27/00; A41D 1/02; A41D 27/10; A41D 27/13; A41D 2500/00;

(Continued)

(56) References Cited

U.S. PATENT DOCUMENTS 2,167,350 A * 7/1939 Eaton ..... A41B 1/00 139/385.5
2,836,826 A * 6/1958 Geiss ..... A41D 27/10 2/125

(Continued)

FOREIGN PATENT DOCUMENTS

EP 0950752 A1 * 10/1999 ..... A41H 3/08
EP 1632349 A2 3/2006
WO 2010109410 A1 9/2010

*Primary Examiner* — Amy Vanatta

(74) *Attorney, Agent, or Firm* — RMCK Law Group, PLC

(57) ABSTRACT

A method of matching/combining distinct fabrics into a single article of clothing comprises obtaining a first fabric defining a color pattern, obtaining a second fabric that is distinct from the first fabric, the second fabric being a plain or solid color fabric, using a digital fabric printer to print the color pattern of the first fabric onto the second fabric to obtain a modified second fabric that also defines the color pattern, and combining the first fabric and the modified second fabric into the single article of clothing. The digital fabric printer can also be used to print the color pattern onto the first fabric. The first and/or second fabrics can also be formed using a yarn-dye process. A system for matching/combining distinct fabrics into a single article of clothing includes a yarn weaving/knitting system and/or a digital fabric printer, a fabric combining system, and an optional color pattern analyzer.

13 Claims, 3 Drawing Sheets

(52) U.S. Cl.
CPC ..... *A41H 42/00* (2013.01); *A41B 2400/60* (2013.01); *A41B 2500/10* (2013.01); *A41B 2500/20* (2013.01); *A41D 2500/00* (2013.01)

(58) Field of Classification Search
CPC .. A41D 2500/10; A41D 2500/20; A41D 1/18; A41H 3/08; A41H 42/00; A41H 1/00; A41H 3/02; A41H 3/007; A41B 1/08; A41B 1/00; A41B 2500/00; A41B 2500/10; A41B 2500/20; A41B 2400/60; D03D 2700/1422; D03C 19/00; D03C 19/005; D06P 3/00; D06P 5/00; B41M 5/00; B41M 5/0041
USPC ..... 700/133, 130, 131, 132, 135; D2/849
See application file for complete search history.

(56) References Cited

U.S. PATENT DOCUMENTS 4,000,342 A * 12/1976 Rochelle ..... D06C 23/02 428/88
4,025,963 A * 5/1977 Sugita ..... A41H 3/08 2/243.1
D278,477 S * 4/1985 Mizuno ..... G06F 17/50 D2/849
4,576,610 A 3/1986 Donenfeld
7,081,324 B1 7/2006 Hare et al.
7,819,927 B2 10/2010 Greenspoon
7,900,645 B2 3/2011 Bunce et al.
7,922,778 B2 4/2011 Grier
8,485,657 B2 7/2013 Pinto et al.
8,870,972 B2 10/2014 Grier et al.
2003/0190853 A1* 10/2003 Lovingood ..... D03D 15/00 442/209
2007/0079419 A1* 4/2007 Spruill ..... A41D 1/04 2/69
2007/0260352 A1* 11/2007 Magee ..... G06T 11/001 700/131
2011/0070412 A1* 3/2011 Ly ..... B32B 5/10 428/196
2014/0259457 A1* 9/2014 Byrd ..... D06P 3/241 8/485
2016/0263928 A1* 9/2016 Costin, Jr. ..... B41M 7/0009
2017/0247544 A1* 8/2017 Yagi ..... B41M 5/00
2018/0049496 A1* 2/2018 Benefiel ..... G06F 17/50

* cited by examiner

TECHNIQUES FOR MATCHING AND COMBINING DISTINCT FABRICS INTO A SINGLE ARTICLE OF CLOTHING

CROSS-REFERENCE TO RELATED APPLICATION

This application claims the benefit of U.S. Provisional Application No. 62/425,134, filed on Nov. 22, 2016. The disclosure of the above application is incorporated herein by reference in its entirety.

FIELD

The present application is generally directed to textile manufacturing and, more particularly, to techniques for matching and combining distinct fabrics into a single article of clothing.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In textile manufacturing, different fabrics can provide different benefits. Some fabrics, for example, may be cheaper or more breathable than other fabrics. A single article of clothing may comprise two or more distinct fabrics. The differences between these distinct fabrics, however, are often very noticeable, which can make such articles of clothing less visually appealing.

SUMMARY

According to one aspect of the present disclosure, a method of matching and combining two distinct fabrics into a single article of clothing is presented. In one exemplary implementation, the method can comprise obtaining a first fabric defining a color pattern; obtaining a second fabric that is distinct from the first fabric, the second fabric being a plain or solid color fabric; using a digital fabric printer, printing the color pattern of the first fabric onto the second fabric to obtain a modified second fabric that also defines the color pattern; and combining the first fabric and the modified second fabric into the single article of clothing.

In some implementations, the first fabric is a modified version of an unmodified first fabric, and obtaining the first fabric further comprises using the digital fabric printer to print the color pattern onto the unmodified first fabric.

In some implementations, obtaining the first fabric further comprises: obtaining a set of dyed yarns; and weaving or knitting the set of dyed yarns to form the first fabric defining the color pattern.

In some implementations, one of the first fabric and the modified second fabric is a moisture-wicking fabric and the single article of clothing is a dress shirt. In some implementations, combining the first fabric and the modified second fabric includes forming one or more distinct portions of the dress shirt using the moisture-wicking fabric. In some implementations, the one or more distinct portions of the dress shirt include an underarm gusset. In some implementations, the one or more distinct portions of the dress shirt include a portion of a back of the dress shirt. In some implementations, the one or more distinct portions of the dress shirt include a collar.

According to another aspect of the present disclosure, a method of matching and combining two distinct fabrics into a single article of clothing is presented. In one exemplary implementation, the method can comprise obtaining a first fabric defining a color pattern; obtaining a first set of dyed yarns; weaving or knitting the first set of dyed yarns to form a second fabric that is distinct from the first fabric and that also defines the color pattern; and combining the first and second fabrics into the single article of clothing.

In some implementations, obtaining the first fabric comprises: obtaining a second set of dyed yarns that are distinct from the first set of dyed yarns; and weaving or knitting the second set of dyed yarns to form the first fabric defining the color pattern.

In some implementations, obtaining the first fabric comprises: obtaining an unmodified first fabric defining a plain or solid color; and using a digital fabric printer, printing the color pattern onto the unmodified first fabric to obtain the first fabric.

In some implementations, one of the first and second fabrics is a moisture-wicking fabric and the single article of clothing is a dress shirt. In some implementations, combining the first fabric and the modified second fabric includes forming one or more distinct portions of the dress shirt using the moisture-wicking fabric. In some implementations, the one or more distinct portions of the dress shirt include an underarm gusset. In some implementations, the one or more distinct portions of the dress shirt include a portion of a back of the dress shirt. In some implementations, the one or more distinct portions of the dress shirt include a collar.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

As mentioned above, different fabrics that are combined into a single article of clothing can make the article of clothing less visually appealing. Therefore, there is a need to seamlessly match/blend these different fabrics such that it appears as if the article of clothing were made of a single fabric. Matching color patterns, however, can be difficult because different fabrics exhibit different characteristics. For example, a certain color pattern may appear different on cotton compared to a moisture-wicking polyester. Accordingly, techniques are presented for matching and combining two distinct fabrics into a single article of clothing.

In one exemplary implementation, the article of clothing is a dress shirt formed primarily of cotton or a cotton-blend fabric, with one or more distinct portions formed of a moisture-wicking polyester fabric to help alleviate the problem of sweat while wearing the dress shirt. Non-limiting examples of these distinct portions of the dress shirt include an underarm gusset, a portion of a back of the dress shirt, and a collar of the dress shirt. It will be appreciated that other distinct portions of the dress shirt could be formed of the moisture-wicking fabric, such as portions that are likely to coincide with sweat (e.g., a lower portion of a front of the dress shirt corresponding to a lower stomach), as well as combinations of two or more of these distinct portions (e.g., underarm gussets, back portion, and neck). It will also be appreciated that these techniques can be extended to matching any two or more distinct fabrics for incorporation into any article of clothing.

Figure 1:
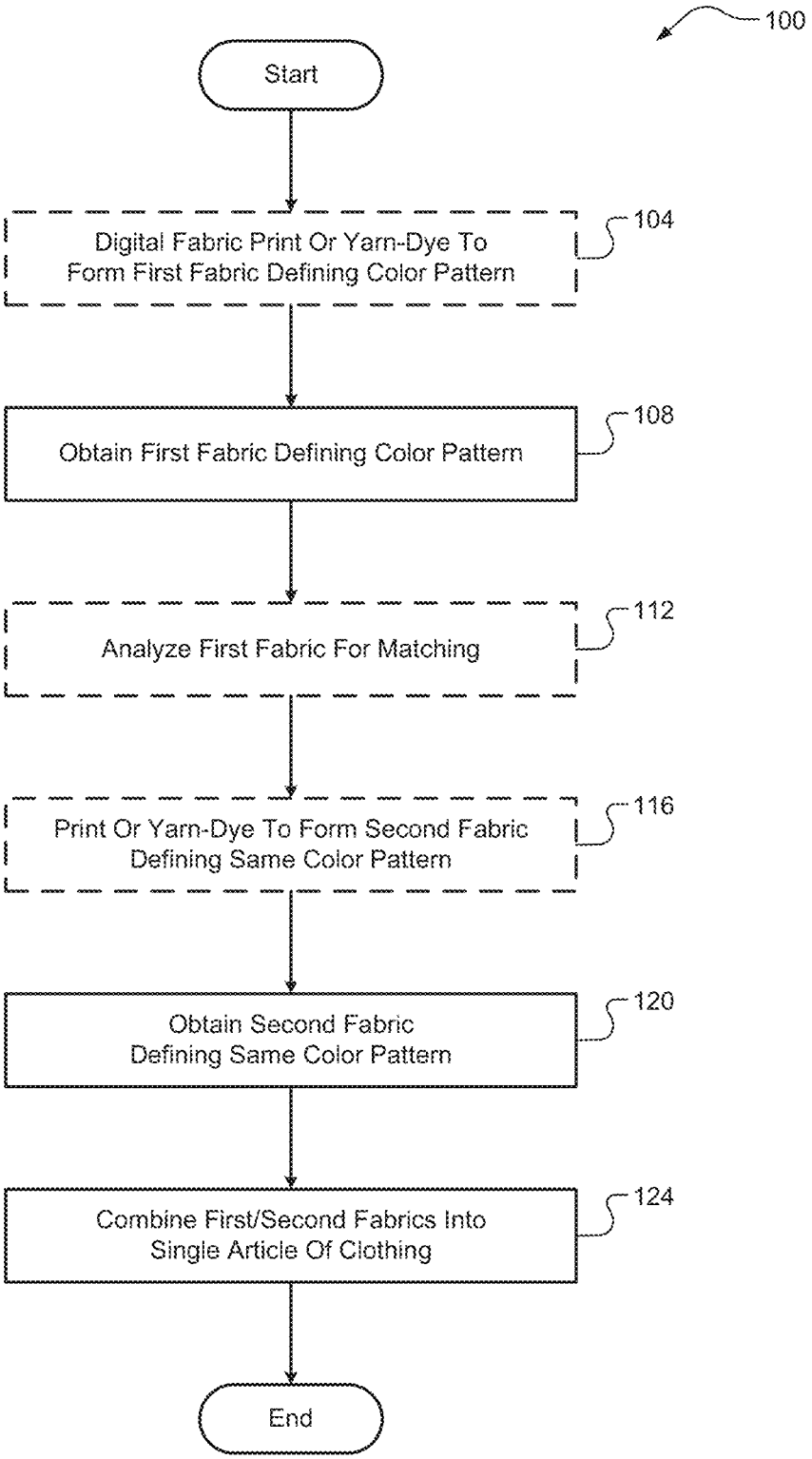
FIG. 1 depicts a flow diagram of an example method of matching and combining two distinct fabrics into a single article of clothing according to some implementations of the present disclosure.
Figure 2:
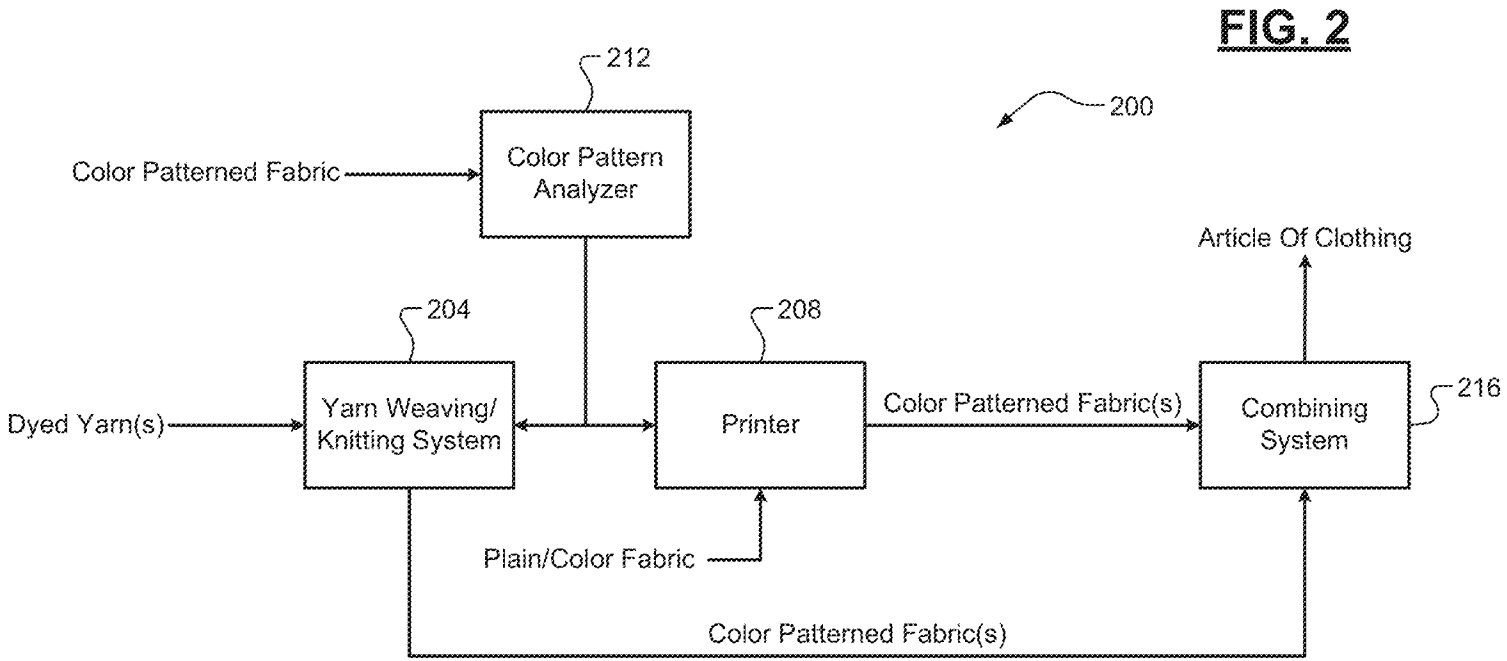
FIG. 2 depicts a functional block diagram of an example system for matching and combining two distinct fabrics into a single article of clothing according to some implementations of the present disclosure.

Referring now to FIGS. 1-2, an example method 100 and an example system 200 for matching and combining two distinct fabrics into a single article of clothing are illustrated. At 108, a first fabric defining a color pattern is obtained. In some implementations, this first fabric is pre-manufactured. In other implementations, the first fabric is formed at optional 104. In one exemplary implementation, the formation of the first fabric can involve using a yarn-dye process. This process can involve obtaining a set of dyed yarns and then using a yarn weaving/knitting system 204 to weave/knit the dyed yarn(s) into the first fabric defining the color pattern. Alternatively, a digital printing process can be used in which a printer 208 for obtaining a colored/patterned fabric.

For example, an unmodified version of the first fabric (plain or solid color in nature) may initially be obtained, and then it can be modified using the digital printer to create a modified version of the first fabric defining a new color print. In one implementation, the printer 208 is a digital fabric printer that is used to print the color pattern onto a plain or single colored fabric. In another implementation, the printer 208 is a three-dimensional (3D) printer that is used to develop one or both of the colored/patterned fabrics. For example, the first fabric could be obtained using the yarn-dye and weaving/knitting processes and then the second fabric could be 3D printed based on or using the first fabric. One example of the color pattern is a Gingham pattern as depicted by a dress shirt 300 in FIG. 3A.

At optional 112, the first fabric is analyzed (e.g., using a color pattern analyzer 212) to determine the color pattern. This analysis may be required, for example, when the first fabric is pre-manufactured and there are no dyes or print settings to access. While a color pattern analyzer 212 (e.g., a computing device with a camera and imaging software) could be used, it will be appreciated that a human operator can analyze the pattern and then adjust dyes/print settings accordingly. At 120, a second fabric having the same color pattern is obtained. This second fabric is distinct from the first fabric in that they are made of different materials. One example of the first fabric is cotton or a cotton-blend and one example of the second fabric is a moisture-wicking polyester, or vice-versa. Similar to the first fabric, the second fabric could be pre-manufactured or could be formed at optional 116 using a yarn-dye process with yarn weaving/knitting system 204 or a printing process with the printer 208.

Figure 3B:
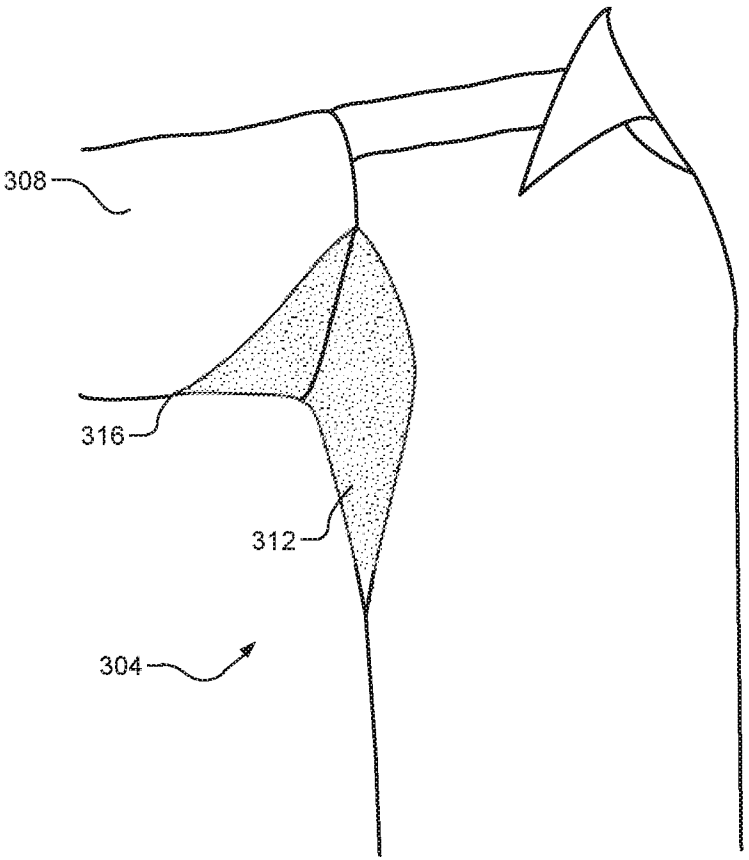
FIGS. 3A-3B depict views of an example dress shirt formed using the method of FIG. 1 and/or the system of FIG. 2.
Figure 3A:
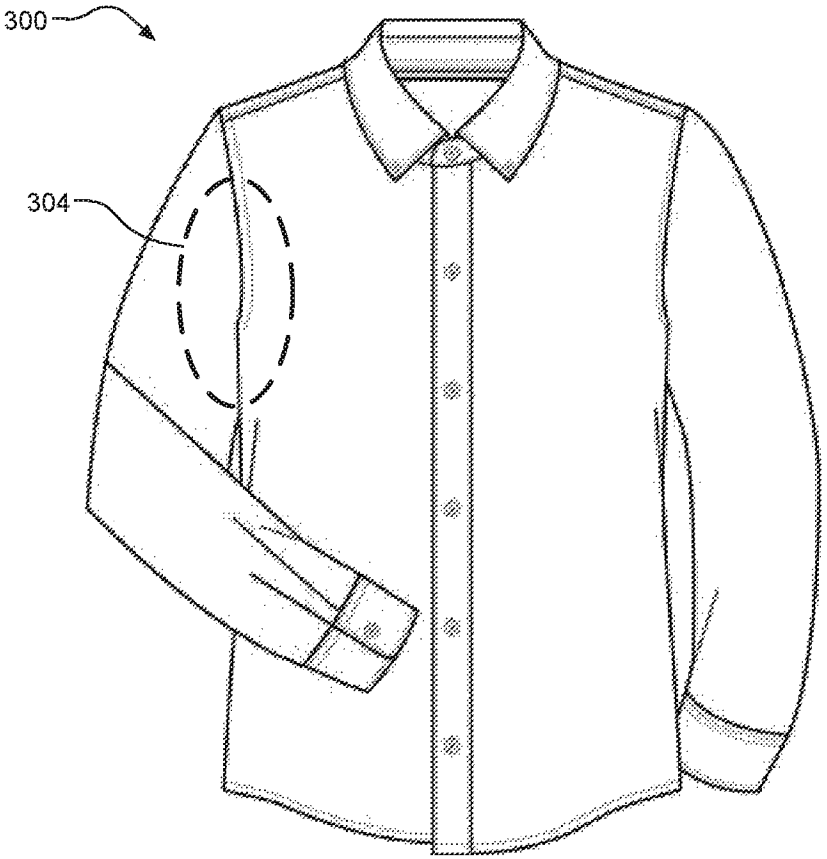

At 124, the first and second fabrics are combined into a single article of clothing. As previously mentioned, FIG. 3A illustrates an example dress shirt having a Gingham color pattern. An underarm gusset 304 (shown in greater detail in FIG. 3B) is where the first and second fabrics are combined. More particularly, one of the first and second fabrics is a cotton or cotton-blend fabric 308 that makes up the majority of the dress shirt 300. The other of the first and second fabrics, on the other hand, is moisture-wicking polyester 312 that forms the underarm gusset 304. These fabrics are combined, for example, by sewing/stitching the fabrics together (e.g., using combining system 216), which can be seen at seam 316. As can also be seen in FIG. 3A, the dress shirt 300 appears to be formed of a single fabric, even though the underarm gusset is formed of an entirely distinct fabric.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known procedures, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The term "and/or" includes any and all combinations of one or more of the associated listed items. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of matching and combining distinct fabrics into a single article of clothing, the method comprising:

obtaining, via a yarn dye process, a first fabric defining a color pattern;

obtaining a second fabric that is distinct from the first fabric, the second fabric being a plain or solid color fabric;

using a digital fabric printer, printing the color pattern of the first fabric onto the second fabric to obtain a modified second fabric that also defines the color pattern; and combining the first fabric and the modified second fabric into the single article of clothing.

2. The method of claim 1, wherein the yarn dye process further comprises:

obtaining a set of dyed yarns; and weaving or knitting the set of dyed yarns to form the first fabric defining the color pattern.

3. The method of claim 1, wherein the second and modified second fabrics are a moisture-wicking fabric and the single article of clothing is a dress shirt.

4. The method of claim 3, wherein combining the first fabric and the modified second fabric includes forming one or more distinct portions of the dress shirt using the modified second fabric.

5. The method of claim 4, wherein the one or more distinct portions of the dress shirt include an underarm gusset.

6. The method of claim 4, wherein the one or more distinct portions of the dress shirt include a portion of a back of the dress shirt.

7. The method of claim 4, wherein the one or more distinct portions of the dress shirt include a collar.

8. A method of matching and combining distinct fabrics into a single article of clothing, the method comprising:

obtaining, via a yarn dye process, a first fabric defining a color pattern, wherein the yarn dye process comprises:

obtaining a set of dyed yarns; and weaving or knitting the set of dyed yarns to form the first fabric defining the color pattern;

modifying a second fabric that is distinct from the first fabric to form a modified second fabric that also defines the color pattern; and combining the first and second fabrics into the single article of clothing, wherein modifying the second fabric comprises:

obtaining the second fabric, wherein the second fabric defines a plain or solid color; and using a digital fabric printer, modifying the second fabric by printing the color pattern onto the second fabric to obtain the modified second fabric.

9. The method of claim 8, wherein the second and modified second fabrics are a moisture-wicking fabric and the single article of clothing is a dress shirt.

10. The method of claim 9, wherein combining the first fabric and the modified second fabric includes forming one or more distinct portions of the dress shirt using the modified second fabric.

11. The method of claim 10, wherein the one or more distinct portions of the dress shirt include an underarm gusset.

12. The method of claim 10, wherein the one or more distinct portions of the dress shirt include a portion of a back of the dress shirt.

13. The method of claim 10, wherein the one or more distinct portions of the dress shirt include a collar.

* * * * *